US005607807A

United States Patent [19]

Odell et al.

[11] Patent Number: 5,607,807

[45] Date of Patent: Mar. 4, 1997

[54] SUPERCRITICAL PROCESSES AND LIQUID DEVELOPERS

[75] Inventors: Peter G. Odell, Mississauga, Canada; George A. Gibson; James R. Larson, both of Fairport, N.Y.; Frank J. Bonsignore, Rochester, N.Y.

[73] Assignee: Xerox Corporation, Stamford, Conn.

[21] Appl. No.: 501,529

[22] Filed: Jul. 12, 1995

[51] Int. Cl.[6] ..... G03G 9/125

[52] U.S. Cl. ..... 430/137

[58] Field of Search ..... 430/106, 109, 430/114, 137

[56] References Cited

U.S. PATENT DOCUMENTS

| | | | |
|---|---|---|---|
| 5,223,368 | 6/1993 | Ciccarelli et al. | 430/110 |
| 5,306,591 | 4/1994 | Larson et al. | 430/115 |
| 5,308,731 | 5/1994 | Larson et al. | 430/115 |
| 5,487,965 | 1/1996 | Odell | 430/137 |

*Primary Examiner*—John Goodrow
*Attorney, Agent, or Firm*—E. O. Palazzo

[57] ABSTRACT

A process for the preparation of liquid developers which comprises contacting said developers with supercritical carbon dioxide.

12 Claims, No Drawings

SUPERCRITICAL PROCESSES AND LIQUID DEVELOPERS

BACKGROUND OF THE INVENTION

This invention is generally directed to liquid developer compositions, and more specifically, the present invention relates to the preparation of liquid developers with high solids content wherein supercritical mediums, such as carbon dioxide, are selected. In embodiments, the process of the present invention utilizes attritors and supercritical carbon dioxide, and wherein subsequent to high solids attrition the solids and the medium, such as hydrocarbon fluid, of the liquid developer are removed, transferred to a suitable vessel, such as a known pressure vessel, which vessel is thereafter sealed, and subsequently, there is introduced into the vessel pressured carbon dioxide. There is enabled with the processes of the present invention in embodiments high solids liquid developers, wherein high refers to, for example, from about 20 to about 50 percent of thermoplastic resin, pigment, and charge control agent, or charge adjuvant.

Liquid developers are known, reference for example U.S. Pat. No. 5,308,731, the disclosure of which is totally incorporated herein by reference, wherein there is illustrated a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof; U.S. Pat. No. 5,306,591, the disclosure of which is totally incorporated herein by reference, which discloses a liquid developer comprised of thermoplastic resin particles, a charge director, and a charge adjuvant comprised of an imine bisquinone; and United States Statutory Invention Registration No. H1483, the disclosure of which is totally incorporated herein by reference, which discloses a liquid developer comprised of thermoplastic resin particles, and a charge director, especially the methyl HBR salt thereof, comprised of an ammonium AB diblock copolymer. Moreover, in U.S. Patent No. 5,525,449, the disclosure of which is totally incorporated herein by reference, and wherein there is illustrated a liquid electrostatographic developer comprised of (A) a nonpolar liquid having a Kauri-butanol value of from about 5 to about 30, and present in a major amount of from about 50 percent to about 95 weight percent; (B) thermoplastic resin particles having an average volume particle diameter of from about 5 to about 30 microns, and pigment; (C) a charge director, such as an aliphatic alcohol mixture; and (D) a charge adjuvant. Illustrated in U.S. Pat. No. 5,525,448, the disclosure of which is totally incorporated herein by reference, is a positively charged liquid developer comprised of thermoplastic resin particles, pigment, a charge director, and an insoluble charge adjuvant comprised of a polymeric quaternary ammonium compound, and wherein the charge adjuvant is associated with or combined with said resin and said pigment; and U.S. Ser. No. 204,016, abandoned the disclosure of which is totally incorporated herein by reference, is a liquid developer comprised of thermoplastic resin particles, optional pigment, and a charge director comprised of a mixture of an organic anionic complex phosphate ester and organic aluminum complex, or mixtures thereof of the formulas

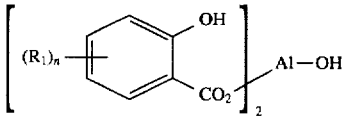

-continued or

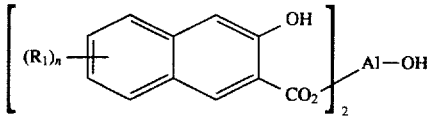

wherein $R_1$ is selected from the group consisting of hydrogen and alkyl, and n represents a number.

In the aforementioned U.S. Pat. No. 5,525,449 it is indicated that liquid electrostatic developers can be prepared by a variety of known processes such as, for example, mixing in a nonpolar liquid the thermoplastic resin and colorant in a manner that the resulting mixture contains, for example, about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding the charge adjuvant compound to the dispersion; diluting the dispersion; and thereafter adding a charge director. In the initial mixture, the resin, colorant and optional charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, NY), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch, or about 1.0 to about 13 millimeters. Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably from about 75° C. to about 110° C. The mixture may be ground in a heated ball mill or heated attritor at this temperature for about 15 minutes to about 5 hours, and preferably about 1 to about 3 hours. After grinding at the above temperatures, an additional amount of nonpolar liquid may be added to the dispersion. The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like, in a jacket surrounding the mixing vessel. Cooling may be accomplished, for example, in the same vessel, such as the attritor, while simultaneously grinding with particulate media to prevent the formation of a gel or solid mass without stirring to form a gel or solid mass, followed by shredding the gel or solid mass, and grinding by means of particulate media, or with stirring to form a viscous mixture, and grinding by means of particulate media. The resin precipitate is cold ground for about 1 to about 36 hours, and preferably 2 to 6 hours. Additional liquid may be added at any step during the preparation of the liquid developer to facilitate grinding or to dilute the developer to the appropriate percent solids needed for developing.

The disadvantages of utilizing solvents, introducing undesirable fine metallic particles in the liquid developer which can abrade and destroy components in the liquid developer machine are avoided or minimized with the processes of the present invention. In embodiments, the present invention provides a process for obtaining liquid developers with a high solids contents and a desirable size without requiring a concentration step, such as pressure filtration or centrifugation, following attrition, and the process avoids the use of hydrocarbon dilution of the toner during manufacture and the need to recover and recycle or dispose of the hydrocarbon.

Also, reference is made to the following copending patent applications and patents, the disclosures of which are totally incorporated herein by reference, U.S. Pat. No. 5,514,513; U.S. Pat. No. . 5,514,514 and U.S. Pat. No. 5,516,618. which illustrate supercritical processes for the preparation of carrier powder coatings.

SUMMARY OF THE INVENTION

Examples of objects of the present invention include:

It is an object of the present invention to provide liquid toners, and supercritical processes for the preparation thereof.

In another object of the present invention there are provided supercritical carbon dioxide processes for the preparation of liquid developers wherein solvents are eliminated.

In yet another object of the present invention there are provided supercritical carbon dioxide processes for the preparation of liquid developers wherein solvents and metallic particles are eliminated, or minimized since, for example, steel balls are not needed.

Moreover, in another object of the present invention there are provided economical and simplified supercritical carbon dioxide processes for the preparation of liquid developers with high solids contents of from about 15 to about 40 weight percent, and wherein an optional demetallization step can be selected in embodiments.

In another object of the present invention there are provided methods for the development of electrostatic latent images with liquid developers prepared by the supercritical methods illustrated herein.

These and other objects of the present invention are accomplished by providing liquid developer compositions and processes thereof. More specifically, the present invention relates to supercritical carbon dioxide processes for the preparation of liquid developers wherein pressurized carbon dioxide is added to an attrited liquid developer, which carbon dioxide is under pressure, followed by releasing the pressure to enable high solids liquid developers with, for example, from about 30 to about 50 weight percent of toner of resin, pigment, and charge control component dispersed in a liquid hydrocarbon.

In embodiments, the present invention is directed to a process for the preparation of liquid developers which comprises contacting the developers with supercritical carbon dioxide and which contacting is for a period of from about 2 minutes to about 40 minutes; and a process for the preparation of a liquid developer which comprises contacting said developer with supercritical carbon dioxide, and wherein there is accomplished the hot melt mixing, for about 1 to about 6 hours, of thermoplastic resin, pigment, charge control agent, hydrocarbon fluid, and optional charge director in an attritor equipped with carbon steel grinding media; cooling the attritor and its contents to below about 40° C., and, for example, from about 20 to about 35° C., while stirring and further grinding at this temperature for about 2 to 24 hours; transferring the resulting developer and grinding media mixture to a pressure vessel and washing the developer from the grinding media with high pressure carbon dioxide fluid; removing metal impurities by passing the developer suspended in carbon dioxide through a magnetic filter; and recovering the high solids developer by releasing the carbon dioxide pressure.

Examples of liquid carriers or hydrocarbons selected for the developers and processes of the present invention include a liquid with an effective viscosity of, for example, from about 0.5 to about 500 centipoise, and preferably from about 1 to about 20 centipoise, and a resistivity greater than or equal to $5\times10^9$ ohm/centimeter, such as $10^{13}$ ohm/centimeter or more, and other known liquid developer hydrocarbons. Preferably, the liquid selected in embodiments is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are known and should have an electrical volume resistivity in excess of about $10^9$ ohm-centimeters, and a dielectric constant below or equal to 3.0. Moreover, the vapor pressure at 25° C. should be less than or equal to 10 Torr in embodiments.

While the ISOPAR® series liquids are the preferred nonpolar liquids in embodiments for use as dispersants in the liquid developers of the present invention, the important characteristics of viscosity and resistivity can be achieved, it is believed, with other suitable liquids. Specifically, the NORPAR™ series available from Exxon Corporation, the SOLTROL® series from the Phillips Petroleum Company, and the SHELLSOL® series from the Shell Oil Company can be selected. Other fluids ,such as USP light mineral oils, such as the SUPERLA® series of mineral oils available from the Amaco Oil Company, are suitable.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably 0.5 to 2.0 percent by weight.

Various suitable thermoplastic toner resins can be selected for the liquid developers of the present invention in effective amounts, for example, in the range of 99 percent to 40 percent of developer solids, and preferably 95 percent to 70 percent of developer solids; developer solids includes the thermoplastic resin, optional pigment and charge director, and any other optional components that comprise the particles. Examples of such resins include ethylene vinyl acetate (EVA) copolymers (ELVAX®resins, E.I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$ ) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic or methacrylic acid wherein alkyl is from 1 to about 20 carbon atoms like methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an α-β-ethylenically unsaturated acid of either acrylic acid or methacrylic acid. In a preferred embodiment, NUCREL® like NUCREL® 599, NUCREL® 699, or NUCREL®960 is selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 20 percent by weight based on the total weight of solids contained in the developer. The amount of colorant used may vary depending on the use of the developer. Examples of colorants include pigments such as carbon blacks like REGAL 330®, cyan, magenta, yellow, blue, green, brown and mixtures thereof; pigments as illustrated in U.S. Pat. No. 5,223,368, the disclosure of which is totally incorporated herein by reference. The liquid developers illustrated in the copending applications mentioned herein may also be selected for the processes of the present invention.

A variety of processes may be employed to compound the liquid toner components and to effect particle size reduction. For example, about 175.0 grams of the resin NUCREL 599® (a copolymer of ethylene and methacrylic acid available from E.I. DuPont de Nemours & Company, Wilmington, Del.), about 45.4 grams of the cyan pigment (PV FAST BLUE™), about 2.2 grams of bis(3,5-di-t-butylsalicylato) aluminum hydroxide, and about 222 grams of hydrocarbon, ISOPAR M® (Exxon Corporation), can be added to a Union Process attritor (Union Process Company, Akron, Ohio) charged with 0.1857 inch (4.76 millimeters) diameter carbon steel balls. The mixture may be milled in the attritor, which is heated to about 106° C. for about 2 hours by running steam through the attritor jacket, to mix the toner components thoroughly. The attritor is cooled by running water through the attritor jacket to ambient temperature, and the mixture was ground in the attritor for an additional 4 hours. The solids components are comprised of resin, pigment, and bis(3,5-di-t-butylsalicylato) aluminum hydroxide additives in effective amounts; for example about 50 weight percent of toner in 50 weight percent of hydrocarbon ISOPAR M®, and wherein the separate toner components are present at about 38.5 weight percent of resin, 11 weight percent of pigment, and 0.5 weight percent of bis(3,5-di-t-butylsalicylato) aluminum hydroxide, and which amounts can be measured by heating about 20 grams of the suspension of toner of the above composition in ISOPAR M™ under heat lamps, and after about 24 to about 48 hours of heating or until there is no further weight loss due to ISOPAR™ evaporation. The solid constituents were 77 percent by weight of NUCREL® 599, 1 percent of Alohas (bis(3,5-di-t-butylsalicylato) aluminum hydroxide) and 22 percent by weight of PV FAST BLUE™ pigment. Known charge directors can be selected as illustrated herein, reference for example the patents and copending applications mentioned.

The above product is comprised of a solid mass of toner with absorbed hydrocarbon, steel balls and incidental steel particle contamination as a result of wear of the balls. For the toner to be fully functional, it is separated from both the balls and particles. Conventionally, this has been accomplished by washing the toner from the steel balls with additional hydrocarbon fluid and subsequently passing the suspension through a magnetic filter to remove the small particles of steel, which if left in the toner would cause rapid wear of print engine components. To achieve effective magnetic filtration, a minimum suspension viscosity is required and, for example, it has been found that about 10 percent of toner solids in hydrocarbon is the highest concentration at which the steel particles can be removed. The invention process enables the removal of the high solids toner from the steel balls with carbon dioxide fluid at near- to super- critical pressures of about 800 to over 4,000 psi. The temperature can vary for this step, and it should be below the temperature at which the toner particles start to agglomerate, for example a temperature of about 60° C.; a lower temperature, however, may be selected, for example 25 to 40° C., and the temperature may vary during the process steps. There is a potential advantage in being above the critical temperature of carbon dioxide, about 31° C., as that would insure that a second $CO_2$ phase does not form since a second phase might alter the uniformity of the process. Some additional application of heat may be advantageous to compensate the cooling of the process as the pressure is released.

The invention process comprises in embodiments transferring the toner, hydrocarbon ISOPAR M® and steel ball mixture from the attritor by removing the stirring element and tipping the attritor vessel, or in embodiments where the suspension has sufficient flow and removing the attritor contents via the bottom valve. The resulting suspension may be placed in a pressure vessel, either as is or processed a portion at a time; and wherein the process time of the wash is much less than the attrition step, about 10 to 20 minutes versus about 6 to about 7 hours. As pressure vessels increase in cost with size, it is often advantageous to divide the output of the attritor into smaller portions and wash in a smaller pressure vessel while the attritor is used to produce more toner with its longer process time.

The wash vessel can be any pressure vessel capable of safely operating at pressures up to, for example, about 6,000 psi or more that has provision for a large opening to admit the toner —steel ball mixture and then be rapidly sealed, a second opening fitted with a coarse screen to retain the steel balls but allow the toner suspension to readily pass, and a third opening for the addition of carbon dioxide. Optional provisions include a thermal well. Optionally, a sight gauge, such as a Jerguson Model #11T40, may be provided to monitor the extent of the wash, that is, for example, when toner is no longer seen in the $CO_2$ phase the wash is complete. The suspension in $CO_2$ then passes through a vessel equipped with magnets to remove the fine particulate steel contamination. This vessel contains a number of magnets of sufficient strength to effectively remove the steel contaminants. Provision can be made in this vessel for occasional opening and cleaning; optional provisions include static mixing elements to ensure that the entire suspension passes closely by the magnetic elements, or recirculating the suspension several times through the magnetic filter with an optional pump. Subsequent to the magnetic filter, the $CO_2$ pressure may be released and the toner recovered. On a small scale, this may be accomplished with a simple sintered metal element, 64 micron pore size is often sufficient, to retain the toner despite its much smaller particle size (2 to 3 micron); optionally a smaller pore size can be used. A preferred recovery system, particularly at the larger scale, would be a cyclone or similar device to separate the carbon dioxide from the toner particles without the possible clogging of a filter element. The separation need not necessarily be conducted at atmospheric pressure; the cyclone could be operated at, for instance, 700 psi at which point the $CO_2$ is a gas and the toner particles would readily separate, but the higher pressure would reduce the energy required to recompress the gas. In such a situation, provision would be provided in the valving to isolate, depressurize and empty the cyclone collection vessel. The $CO_2$ could then be further filtered to remove trace toner particles or hydrocarbon, and then recompressed for further use in washing.

A variety of pumping systems may be considered for the carbon dioxide including diaphragm compressors, piston and syringe pumps. The efficiency of the process will be a function of the ratio of pump capacity to vessel size. The pressure employed can vary over a wide range and need not be the same throughout the process, however, higher pressures result in higher $CO_2$ density and as the carbon dioxide density reaches or exceeds the density of the particles; at about 6,000 psi and temperatures of about 30 to about 35° C., the density of $CO_2$ would be about 1.0 gram/milliliter or about that of the particles, the denser fluid should be more efficient as a wash particularly in counter-current embodiments, however, the gain in efficiency must be weighed against the cost of operating at a higher pressure. Cooling the fluid to about 0° C. provides a density of about 1 gram/milliliter at pressures of about 3,500 psi (pounds per square inch). The wash procedure is mated with the attritor toner preparation which is usually practiced in a batch mode. Thus, the wash step may also be conveniently accomplished as a batch operation. The use of a continuous process is also possible by employing upper and lower blowcases to admit and discharge the steel balls with a $CO_2$ counter-current wash upward as the balls fall downward. U.S. Pat. Nos. 4,820,537 and 4,951,561, the disclosures of which are totally incorporated herein by reference, disclose somewhat similar systems for coffee bean extraction. Alternatively, an auger could drive the steel media in the opposite direction to the $CO_2$ flow.

In another embodiment, additional hydrocarbon can be added as an entrainer or modifier to the supercritical carbon dioxide to compensate for serendipitous extraction of hydrocarbon by the process, or to otherwise change the solid to hydrocarbon ratio. Alternatively, the initial formulation in the attrition step can be adjusted to compensate for any hydrocarbon loss during the wash cycle.

Other modifications of the present invention may occur to those of ordinary skill in the art based upon a reading of the present disclosure, and these modifications are intended to be included within the scope of the present invention.

What is claimed is:

1. A process for the preparation of a liquid developer which comprises contacting said developer with supercritical carbon dioxide, and wherein there is accomplished the hot melt mixing, for about 1 to about 6 hours, of thermoplastic resin, pigment, charge control agent, hydrocarbon fluid, and optional charge director in an attritor equipped with carbon steel grinding media; cooling the attritor and its contents to below about 40° C. while stirring and further grinding at said temperature for about 2 to 24 hours; transferring the resulting developer and grinding media mixture to a pressure vessel, and washing the developer from the grinding media with high pressure carbon dioxide fluid; removing metal impurities by passing the developer suspended in carbon dioxide through a magnetic filter; and recovering the high solids developer by releasing the carbon dioxide pressure.

2. A process in accordance with claim 1 wherein there is selected as said liquid developers a mixture of resin, pigment, charge control agent, hydrocarbon fluid, and charge director.

3. A process in accordance with claim 1 wherein the carbon dioxide is selected in an amount of about ten to about a thousand times by weight of the toner solids.

4. A process in accordance with claim 1 wherein the pigment is cyan, magenta, yellow, red, green, blue, brown, or mixtures thereof, or carbon black.

5. A process in accordance with claim 1 wherein said developer is comprised of resin in an amount of from 85 percent to 99.9 percent by weight based on the total weight of the developer solids of resin, pigment, and charge control agent, which agent is present in an amount of from about 0.1 percent to about 15 percent by weight, and wherein said pigment is present in an amount of from about 7 to about 15 weight percent.

6. A process in accordance with claim 1 wherein the hydrocarbon fluid liquid is an aliphatic hydrocarbon.

7. A process in accordance with claim 6 wherein the aliphatic hydrocarbon is a mixture of branched hydrocarbons with from about 10 to about 20 carbon atoms.

8. A process in accordance with claim 1 wherein the carbon dioxide released is recycled.

9. A process in accordance with claim 1 wherein said below about 40° C. is from about 20° C. to about 35° C.

10. A process in accordance with claim 1 wherein said high solids is from about 20 to about 50 percent, and which solids contain thermoplastic resin, charge control agent, and pigment.

11. A process in accordance with claim 1 wherein said high solids is from about 15 to about 40 percent, and said solids contain said resin, said charge control agent, and said pigment.

12. A process in accordance with claim 1 wherein said high pressure carbon dioxide fluid is at critical pressures of from about 8,000 to about 4,000 pounds per square inch.

* * * * *